US011730269B1

(12) United States Patent
Rosebrook

(10) Patent No.: US 11,730,269 B1
(45) Date of Patent: Aug. 22, 2023

(54) POSTURE CONTROL CHAIR

(71) Applicant: Gary Rosebrook, Lake Stevens, WA (US)

(72) Inventor: Gary Rosebrook, Lake Stevens, WA (US)

( * ) Notice: Subject to any disclaimer, the term of this patent is extended or adjusted under 35 U.S.C. 154(b) by 0 days.

(21) Appl. No.: 17/691,981

(22) Filed: Mar. 10, 2022

(51) Int. Cl.

| | |
|---|---|
| ***A47C 9/00*** | (2006.01) |
| ***A47C 7/48*** | (2006.01) |
| ***A47B 39/10*** | (2006.01) |
| ***A47C 1/036*** | (2006.01) |
| ***A47C 3/30*** | (2006.01) |
| ***A47C 7/54*** | (2006.01) |
| ***A47C 7/46*** | (2006.01) |
| ***A47C 7/50*** | (2006.01) |
| ***A47C 7/74*** | (2006.01) |

(52) U.S. Cl.
CPC ..... *A47C 1/036* (2013.01); *A47B 39/10* (2013.01); *A47C 3/30* (2013.01); *A47C 7/46* (2013.01); *A47C 7/5066* (2018.08); *A47C 7/541* (2018.08); *A47C 7/74* (2013.01); *A47C 9/005* (2013.01)

(58) Field of Classification Search
CPC ..... A47C 9/005; A47C 7/46; A47B 39/10
USPC ..... 297/383, 423.11, 423.12, 464, 465, 485, 297/487, 488
See application file for complete search history.

(56) References Cited

U.S. PATENT DOCUMENTS 4,552,404 A 11/1985 Congleton
4,607,882 A * 8/1986 Opsvik ..... A47C 7/029 297/195.11
4,765,684 A * 8/1988 Kvalheim ..... A47C 13/00 297/423.13 X
4,767,160 A * 8/1988 Mengshoel ..... A47C 9/005 297/423.12 X
4,832,407 A * 5/1989 Serber ..... A47C 9/005 297/423.12
5,054,857 A * 10/1991 Kvalheim ..... A47C 13/00 297/423.12 X
5,255,957 A * 10/1993 Opsvik ..... A47C 7/503 297/423.12 X
5,447,356 A * 9/1995 Snijders ..... A47C 7/405 297/487 X (Continued)

FOREIGN PATENT DOCUMENTS

DE 19925094 A1 * 12/2000 ..... A47C 7/40
GB 2176396 A * 12/1986 ..... A47C 9/005

(Continued)

*Primary Examiner* — Rodney B White
(74) *Attorney, Agent, or Firm* — Gugliotta & Gugliotta LPA

(57) ABSTRACT

A posture correcting chair having a back rest assembly providing mounting attachments for a head or neck rest, a lumbar support, at least one arm rest, and a posture retainer and supported by a seat assembly. The headrest, lumbar, seat and back support all adjust to allow a user to distribute their weight about a greater number of surfaces for adaptive comfort. A posture retainer affixed to the back rest assembly dynamically adjusts to the contour of a user's body based on force and pressure created while seated to provide active posture correction for a user to prevent slumping or slouching. A knee rest assembly is attached to rail system on a lower end of chair the base platform to provide additional support surfaces. The seat and knee rest assembly include heating, cooling or vibrating or massaging.

16 Claims, 4 Drawing Sheets

(56) References Cited

U.S. PATENT DOCUMENTS 5,511,852 A * 4/1996 Kusiak ..... A47C 7/402 297/383 X
5,542,746 A * 8/1996 Bujaryn ..... A47C 9/005 297/423.12
5,582,464 A * 12/1996 Maymon ..... A47C 1/023 297/487 X
5,667,278 A * 9/1997 Li ..... A47C 9/005 297/423.11
5,904,400 A * 5/1999 Wei ..... A47C 3/30 297/383
5,927,815 A * 7/1999 Nakamura ..... A61B 90/60 297/173
6,659,560 B1 * 12/2003 Chi ..... A47C 4/028 297/383
6,877,812 B2 * 4/2005 Congleton ..... A47C 7/40 297/383
6,938,956 B1 * 9/2005 Piretti ..... A47C 7/38 297/284.7
7,090,303 B2 * 8/2006 Kropa ..... A47C 9/002 297/423.12 X
7,234,768 B2 * 6/2007 Manning ..... A47C 9/02 297/488 X
7,618,090 B2 * 11/2009 Grenon ..... A47C 3/18 297/423.12 X
7,722,119 B1 5/2010 Delmestri et al.
8,066,624 B1 11/2011 Stroup
8,449,035 B2 * 5/2013 Breitkreuz ..... A47C 7/42 297/383
8,801,638 B2 * 8/2014 Gierse ..... A61G 7/1096 297/423.11 X
8,864,230 B2 * 10/2014 Augustat ..... A47C 3/20 297/383
9,084,486 B1 * 7/2015 Richardson ..... A47C 7/004
10,524,573 B2 * 1/2020 Richardson ..... A47C 3/00
10,918,213 B2 * 2/2021 Fryer ..... A47C 7/38
10,959,523 B2 * 3/2021 Richardson ..... A61M 37/0076
2005/0206214 A1 * 9/2005 Kosh ..... A44B 11/2592 297/487
2007/0052275 A1 * 3/2007 Ghilzai ..... A47C 1/11 297/423.12
2007/0063569 A1 * 3/2007 Mays ..... A47C 9/005 297/423.12
2008/0143164 A1 * 6/2008 Ghilzai ..... A47C 1/11 297/423.12
2009/0140567 A1 * 6/2009 Weiss ..... A47C 7/5068 297/423.12
2011/0215623 A1 * 9/2011 Tsai ..... A47C 7/402 297/301.1
2011/0304192 A1 12/2011 Augustat
2013/0192928 A1 8/2013 Lamos

FOREIGN PATENT DOCUMENTS

JP 3061647 U * 9/1999 ..... A47C 9/005
JP 2002125803 A * 5/2002 ..... A47C 9/005
KR 20090103468 A * 10/2009 ..... A47C 7/46
KR 20100002612 U * 10/2009 ..... A47C 7/46
KR 20090124050 A * 12/2009 ..... A47C 7/46

* cited by examiner

POSTURE CONTROL CHAIR

RELATED APPLICATIONS

There are no previously filed, nor currently any co-pending applications, anywhere in the world.

BACKGROUND OF THE INVENTION

1. Field of the Invention

The present invention relates generally to office or desk chairs and, more particularly, to improvements to such chairs that actively aid a user's posture while seated.

2. Description of the Related Art

White-collar workers is a moniker that broadly categorizes those who perform professional, desk, managerial, or administrative work. Mostly performed in an office or other administrative setting, such jobs are generally related to government, consulting, academia, accountancy, business and executive management, customer support, design, engineering, market research, finance, human resources, operations research, marketing, information technology, networking, law, healthcare, architecture, and research and development.

Formerly a minority in the agrarian and early industrial societies, white-collar workers have become a majority in industrialized countries due to modernization and outsourcing of manufacturing jobs.

Health problems associated with such work can result from sitting for long periods of the day in a way that results in less physical activity. Such sedentary work has been thought to be a key factor in increased lifestyles related health conditions such as fatigue, obesity, diabetes, hypertension, cancer, and heart disease. Workplace interventions such as alternative activity workstations, sit-stand desks, and promotion of stair use are among measures that are recommended to counter the harm of sedentary workplace environments. Further, for those that have hip, back or neck ailments, the long term uses of existing office or desk chairs can aggravate such ailments to increase discomfort and pain.

Some methods and devices are known that incorporate various mechanisms for assisting a user's posture or distributing body weight while seated. For example:

U.S. Pat. No. 8,066,624, issued in the name of Stroup, discloses an ergonomic exercise posture chair and method of using the same. The exercise chair includes a seat; a base having one or more base supports, the one or more base supports configured to contact a support surface; a seat support supporting the seat, pivotally connected to the base, and biased upward, the seat support including a fulcrum, and wherein downward pressure on the seat by a sitting user causes the fulcrum of the seat support to contact that support surface in addition to one or more of the one or more base supports, forcing the user to maintain a balanced posture on the seat in order to maintain the seat support in a vertical orientation.

U.S. Pat. No. 7,722,119, issued in the name of Delmestri et al., disclose a chair with tiltable seat for convenience and safety for elderly, infirm or injured users. The seat is mounted on an axle to allow the seat front edge to tilt downwardly for ingress and egress purposes and for sitting, the seat will tilt downwardly at the seat rear edge. Cantilevered ends on the chair arms assist in gripping and a footrest is attached to the legs of the chair for user convenience.

U.S. Pat. No. 4,552,404, issued in the name of Congleton, discloses a neutral body posture chair to support a user in a neutral body posture position defined as the natural position a body assumes in weightlessness where the muscle, tendon, and ligament systems acting over the joints are in total balance wherein the trunk of the body forms an angle of approximately 127 degrees with respect to the upper legs and the upper legs form an angle of approximately 127 degrees with the lower legs. The chair includes a seat formed into a bowl at the pelvic area, leg troughs support the upper legs and raised sides to maintain the user in the selected position. The seat further includes an elevated pommel which supports the pubis bone of the user to maintain the user in the desired neutral body posture angle without sliding out of the seat. The chair assembly includes a back rest, footrests, and a suitable base. The chair includes means for adjusting the vertical height of the seat, the tilt angle of the seat, the angle of the backrest, and vertical height of the backrest.

U.S. Patent Application Publication US2011/0304192, published in the name of Augustat, discloses an ergometric chair apparatus that is designed for a female anatomy; the chair includes a seat having proximate and distal end portions forming a first convex surface with a chord plane intersecting, and having a length shorter than its width. The chair also includes a back having first and second end portions that form a second convex surface, wherein, a second lateral measure on the second end is less than a first lateral measure on the first end. The seat plane and an extension axis that are perpendicular to the surface are relatively positioned to one another to form an acute angle to one another, such that a user's femur bone lengthwise angles downward from hip to knee toward the surface while the user's shoulders arch rearward thus aligning the user's hip joint and shoulder joint vertically for better posture.

U.S. Patent Application Publication US 2013/0192928, published in the name of Lamos, discloses a personal kneel posture support assembly comprising a pair of knee supports having attachments whereby the knee supports can be attached to the legs of a user and an intermediate body support. Each of the knee supports and the body support are free standing in the operative position independently of each other on a supporting surface, with each knee support being tethered, directly or indirectly, to the body support and the other knee support by means of one or more elongate flexible connectors. The connectors permit limited movement of the knee supports relative to each other in both horizontal and vertical planes such that a part of any such limited relative movement of the knee supports is operatively transferred by way of the one or more elongate flexible connectors, to the body support that therefore follows the knee supports.

International Patent Publication WO 2017/067706, published in the name of Gunura et al., discloses a Seat unit for wearable sitting posture assisting device comprising at least one sitting means designed to form an adjustable and/or self-adjusting seat surface to be used in at least one at least partly sitting posture and in a walking mode, and comprising a frame means designed to receive a weight force of a person sitting on the sitting means that is mounted on the frame means, and to a wearable sitting posture assisting device with such a seat unit.

While various ergonomic improvements for chairs may exist, none provide multiple options to distribute a user's weight or to actively correct a user's poster. Consequently, a need exists for active posture correction for seated white collar workers.

SUMMARY OF THE INVENTION

It is thus an object of the present invention to provide an office or desk chair that ergonomically corrects a user's sitting posture.

It is a feature of the present invention to provide a chair incorporating a combination of a plurality of active posture assisting elements.

The present invention provides a posture correcting chair having a back rest assembly providing mounting attachment for a head or neck rest, a lumbar support, at least one arm rest, and a posture retainer and supported by a seat assembly. The headrest, lumbar, seat and back support all adjust to allow a user to distribute their weight about a greater number of surfaces for adaptive comfort. A posture retainer affixed to the back rest assembly dynamically adjusts to the contour of a user's body based on force and pressure created while seated to provide active posture correction for a user to prevent slumping or slouching.

A knee rest assembly may be attached to rail system on a lower end of the chair base platform to provide additional support surfaces.

The seat and knee rest assembly include heating, cooling or vibrating or massaging.

Further objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
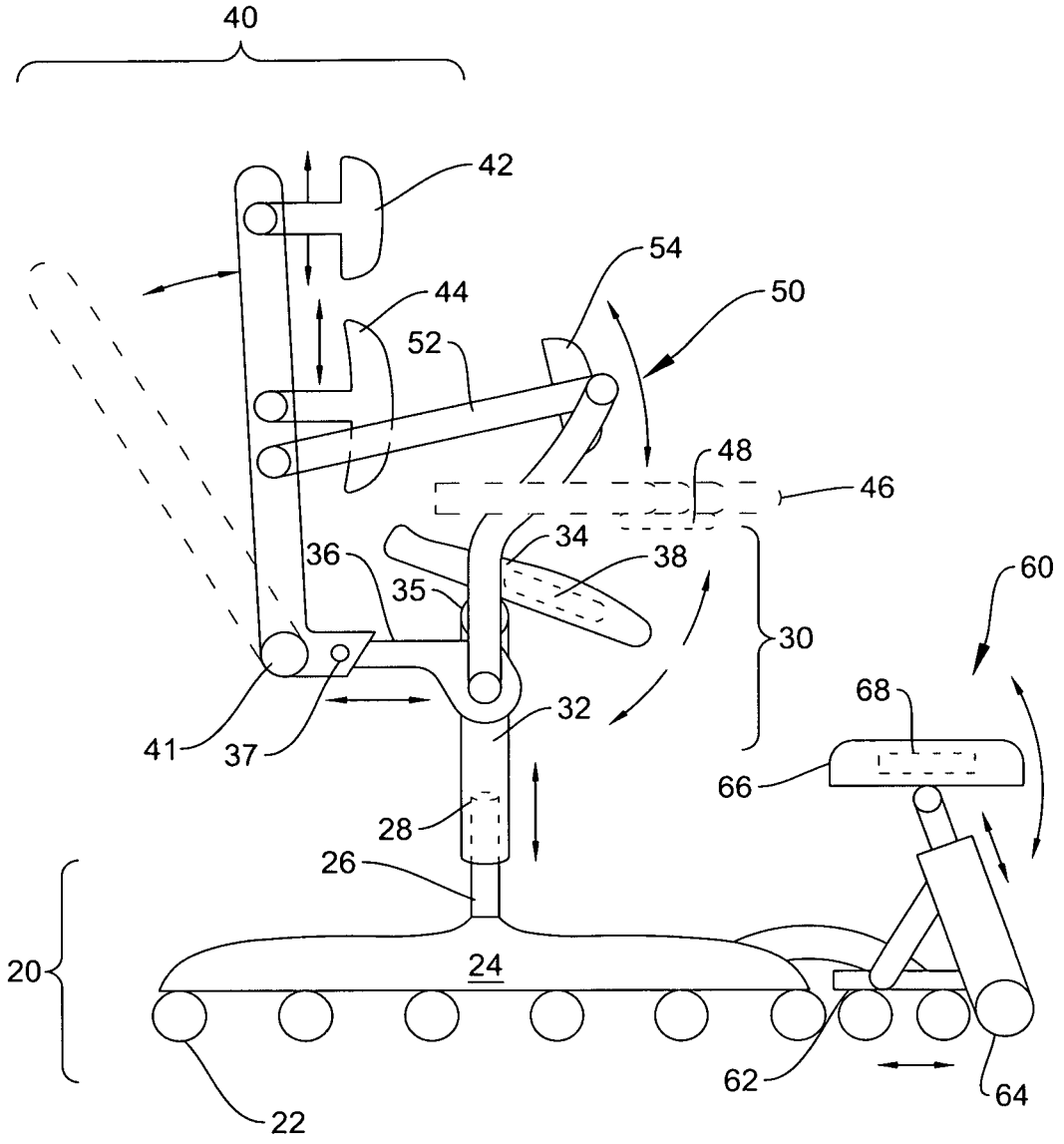
FIG. 1 is a schematic elevational view of a posture correcting chair 10 according to a preferred embodiment of the present invention.
Figure 2:
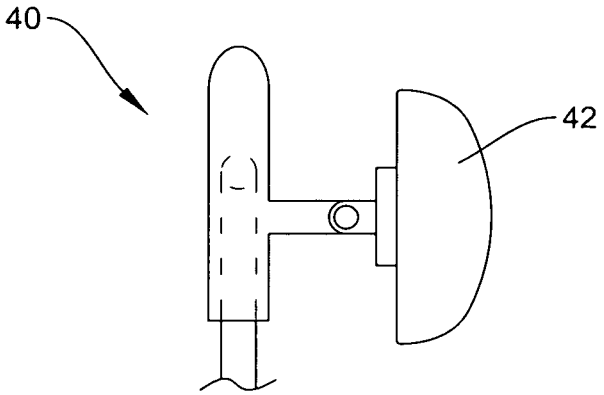
FIG. 2 is a schematic detail of a headrest 42 for use therewith.
Figure 3:
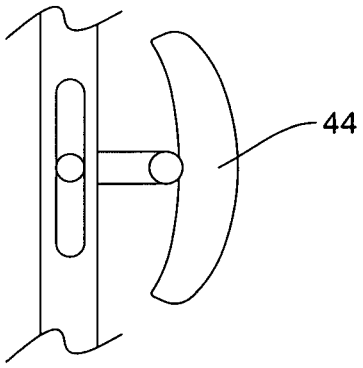
FIG. 3 is a schematic detail of a lumbar support 44 for use therewith.
Figure 4:
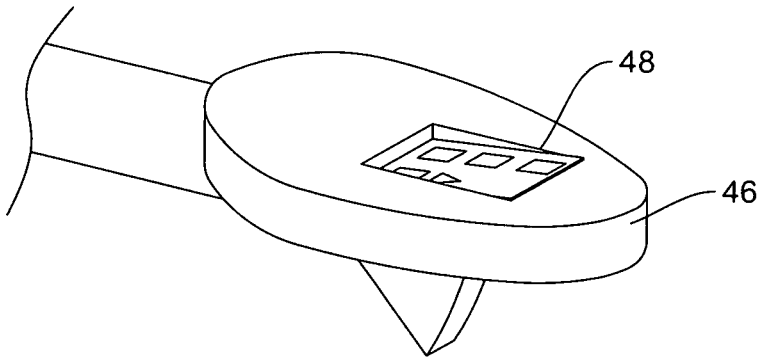
FIG. 4 is a schematic detail of an armrest 46 for use therewith.
Figure 5:
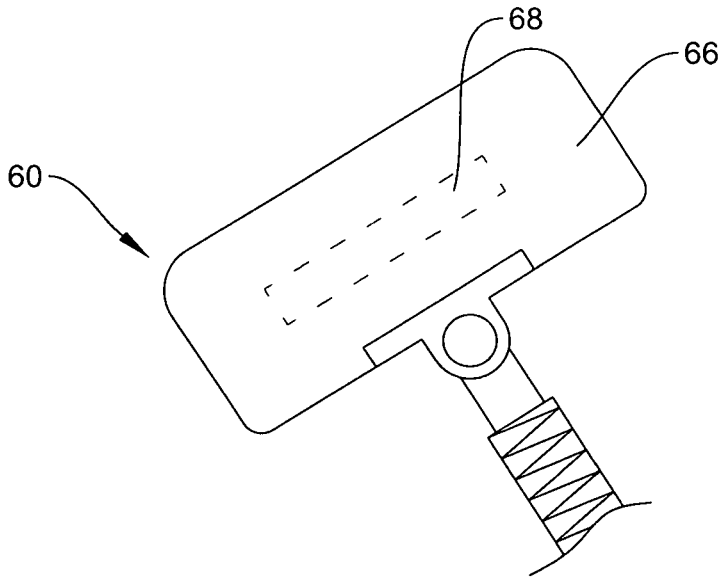
FIG. 5 is a schematic detail of a foot rest 60 for use therewith.

The best mode for carrying out the invention is presented in terms of its preferred embodiment, herein depicted within the Figures.

1. Detailed Description of the Figures

Referring now to the drawings, wherein like reference numerals indicate the same parts throughout the several views, an improved office chair or desk chair of a type adapted for use at a desk in an office, generally noted as 10, is shown according to a preferred embodiment of the present invention. The chair 10 may comprise a combination of: a base 20; a seat assembly 30; a back rest assembly 40; a posture retainer 50; and a knee rest assembly 60.

The base 20 may be adapted with a set of wheels 22 for mobility. The wheels 22 may be swivel wheels or casters of the type that are freely rotatable about 360 degrees of rotation. A plurality of wheels may be provided and positioned about a platform 24 of a sufficient span in order to maintain stability. An upper surface of the base 20 may provide a single, centrally located load-bearing leg 26. The leg 26 may include a height adjustment mechanism in the form of a gas lift 28 which is positioned between the leg 26 and the seat assembly 30 to allow for an adjustable vertical position fo the seat assembly 30.

The seat assembly 30 provides a vertical support 32 for a seat cushion 34. The seat assembly 30 may also provide a horizontal support 36 for the back rest assembly 40. The horizontal support 36 may include an adjustment mechanism 37 to allow for selecting lateral position of the back rest assembly 40 forward or backward relative to the vertical support 32. The cushion 34 may have an adjustment mechanism 35 to provide a pivotal adjustable relative to a horizontal plane. The adjustment mechanism 35 may provide for a number of standard positions throughout increments in order to accommodate a user's comfort preference. The cushion 34 may further include additional comfort features 38, including electronics to provide heating, cooling or massaging.

The back rest assembly 40 provides a generally vertical support that is mounted to the seat assembly 30 and, when laterally positioned by the use, provide support along a vertical plane at a desired distance from the seat 34. In addition to this vertical plane adjustment, the back rest assembly 40 may include an angular reclining adjustment 41 to provide for adjustment divergent from a vertical plane. Further, the back rest assembly may include mounting attachments for: a head/neck rest 42; a lumbar support 44; arm rest 46; and the posture retainer 50. The head/neck rest 42 may be vertically adjustable. The head/neck rest 42 may further be angularly adjustable. In combination these adjustment functions to dynamically adjust to the natural contour of a user's body based on force and pressure created while seated. The lumbar support 44 may be vertically adjustable. The lumbar support 44 may further be angularly adjustable. In combination these adjustment functions to dynamically adjust to the natural contour of a user's body based on force and pressure created while seated. In many office/desk chair environments the use of arm rests 46 may not be required. As such the arm rests 46 may be removable or attachable. When attached, the arm rests 46 may be vertically adjustable. When attached, the arm rests 46 may further be angularly adjustable. In combination these adjustment functions to dynamically adjust to the natural contour of a user's body based on force and pressure created while seated.

The arm rest 46 may further include additional controls 48 for the comfort features 38 to actuate or adjust any provided heating, cooling or massaging.

The posture retainer 50 may further be affixed to the back rest assembly 40 in an adjustable manner. The posture retainer 50 may include a support harness 52 that is positional to circumscribe a user's torso. A chest cushion 54 may be inwardly supported. The support harness 52 may be vertically adjustable. The chest cushion 54 may further be angularly adjustable. In combination these adjustment functions to dynamically adjust to the natural contour of a user's body based on force and pressure created while seated. Overall the posture retainer 50 is adapted to provide active posture correction for a user to prevent slumping or slouching that can be detrimental to a user's wellness and facilitated by work with a keyboard and computer screen.

The knee rest assembly 60 is anticipated as being an optional pendant feature of the chair 10 and may be affixed to the base platform 24. The knee rest assembly 60 may attach to a rail system 62 on the lower end of the base platform 24 where it can adjust and lock into a selected location relative to the base 20. The assembly 60 may be supported by at least two wheels or castors 64 positioned apart for tripod stability in conjunction with the rail system 62. The knee rest assembly 60 may further provide a knee cushion 66. The knee cushion 66 may be vertical, horizontally or rotationally adjustable. The knee cushion 66 may further include additional comfort features 68, including electronics to provide heating, cooling or massaging.

The arm rest 48 may further be in operational control of the comfort features 68 to actuate or adjust any provided heating, cooling or massaging.

2. Operation of the Preferred Embodiment

Figure 6:
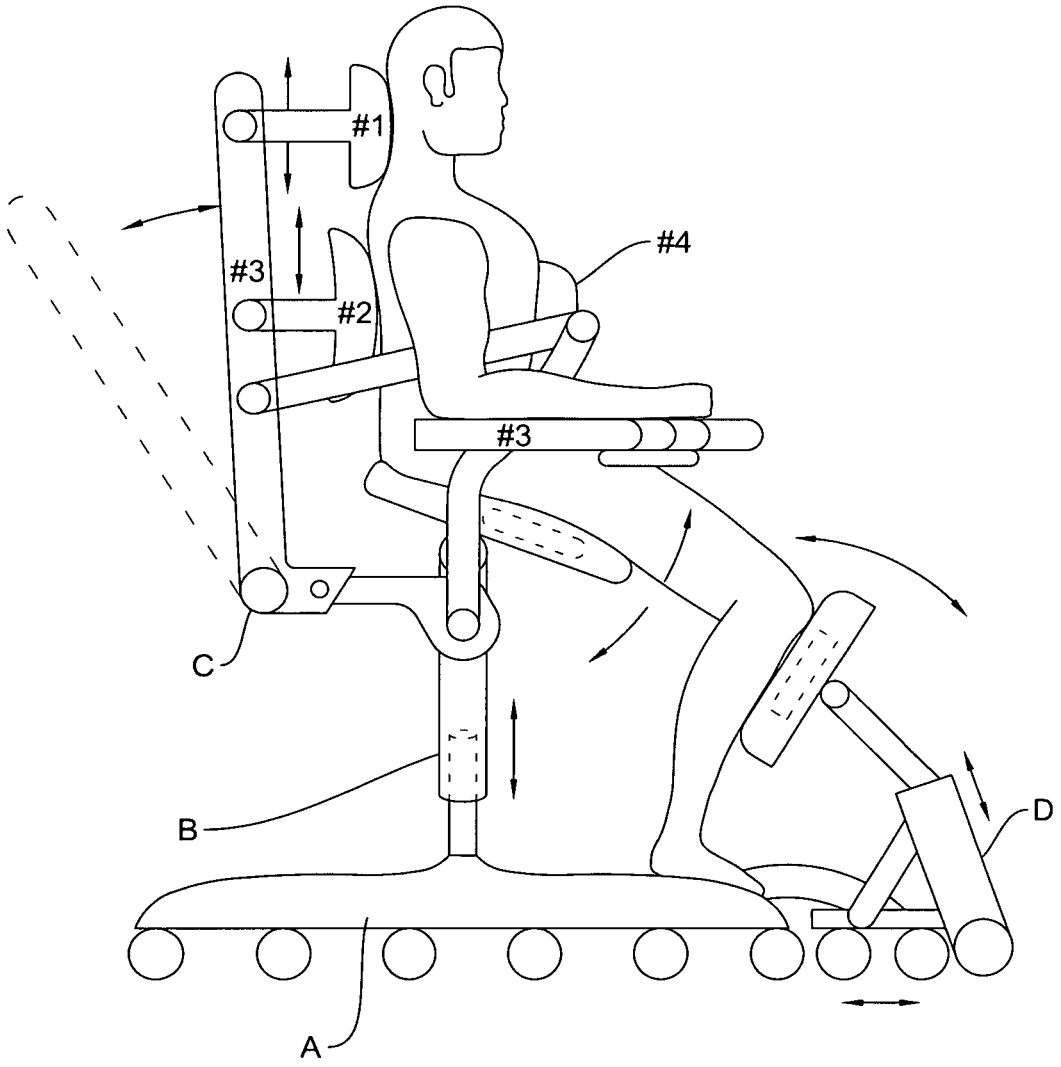
FIG. 6 is a schematic elevational view of the posture correcting chair 10 of FIG. 1 shown adapting to a user in an exemplary general environment according to the present invention.

As shown best in conjunction with FIG. 6, the office chair 10 is shown strategically designed to actively correct the posture of a clerical employee, thereby making it possible for them to remain sitting at their desks for long periods of time. A swiveling chair 10 with casters 22 allows employees to remain sitting and yet reach a number of locations within their work area, eliminating the time and energy expended in standing. The headrest, lumbar, seat and back support all adjust to allow a user to distribute their weight about a greater number of surfaces for adaptive comfort. The posture retainer 50 provides support to urge the user to a position best aligned with their spine and having body weight distributed vertically over the hips to prevent slouching and eliminate back and neck strains that can be generated from extended work at a monitor and keyboard.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. Further, as would be apparent to those having ordinary skill in the relevant art in light of the present teachings, the improvements taught herein are intended to be adapted to or otherwise comport with generally accepted standards for the design and testing of office chairs, including EN 1335:2012, EN 1728:2012, ANSI/BIFMA X 5.1, DIN EN 1335 and/or DIN 4551. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as is suited to the particular use contemplated. It is intended that a scope of the invention be defined broadly by the Drawings and Specification appended hereto and to their equivalents. Therefore, the scope of the invention is in no way to be limited only by any adverse inference under the rulings of Warner-Jenkinson Company, v. Hilton Davis Chemical, 520 US 17 (1997) or Festo Corp. v. Shoketsu Kinzoku Kogyo Kabushiki Co., 535 U.S. 722 (2002), or other similar caselaw or subsequent precedent should not be made if any future claims are added or amended subsequent to this Patent Application.

What is claimed is:

1. A posture control chair comprising:

a seat having an adjustment mechanism to provide a pivotal adjustment relative to a horizontal plane;

a base having a plurality of swivel wheels or casters that are freely rotatable about 360 degrees of rotation and positioned about a platform of sufficient span in order to maintain stability;

a seat assembly supporting the seat, pivotally connected to the base;

a back rest assembly providing mounting attachments for a head or neck rest, a lumbar support, at least one arm rest, and a posture retainer, wherein the seat assembly provides a horizontal support for the back rest assembly and the back rest assembly comprises an angular reclining adjustment for adjustment divergent from a vertical plane;

the horizontal support having an adjustment mechanism to allow for forward or rearward positioning of the back rest assembly relative to the vertical support and the seat;

the posture retainer affixed to the back rest assembly in an adjustable manner to dynamically adjust to a contour of a user's body based on force and pressure created while seated, said posture retainer adapted to provide active posture correction for a user to prevent slumping or slouching.

2. The posture control chair of claim 1, wherein said seat assembly further comprises a single, centrally located load bearing leg having a vertical height adjustment mechanism in the form of a gas lift which is positioned between an upper terminus of the leg and the seat assembly.

3. The posture control chair of claim 1, wherein the adjustment mechanism for the horizontal support includes a plurality of standard position increments.

4. The posture control chair of claim 1, wherein said seat comprises a cushion incorporating a comfort feature selected from a group consisting of: heating; cooling; and vibration or massaging.

5. The posture control chair of claim 4, wherein the at least one arm rest is vertically adjustable and angularly adjustable and comprises a control panel for actuation and adjustment of the comfort features.

6. The posture control chair of claim 1, wherein the head or neck rest is vertically adjustable and angularly adjustable.

7. The posture control chair of claim 1, wherein the lumbar support is vertically adjustable and angularly adjustable.

8. The posture control chair of claim 1, wherein the posture retainer further comprises:

a support harness adapted to circumscribe a user's torso while in a seated position;

a chest cushion inwardly supported at a distal terminus.

9. The posture control chair of claim 1, further comprising:

a knee rest assembly attachable to a rail system on a lower end of the base platform;

at least two wheels or castors positioned on a lower end of the knee rest assembly apart for tripod stability in conjunction with the rail system; and a knee cushion vertical, horizontally or rotationally adjustable to the knee rest assembly.

10. The posture control chair of claim 9, wherein the knee rest assembly further comprises a comfort feature selected from a group consisting of: heating; cooling; and vibrating or massaging.

11. The posture control chair of claim 1, further comprising an adjustable footrest, wherein the adjustable footrest consists of at least one accommodating attributes.

12. The posture control chair of claim 11, wherein the accommodating attributes are selected from a group consisting of: pivoting from a fulcrum connection off the foot plate and foot plate frame; and sliding up and down of the foot plate frame in a manner to enabling adjustment to a selected position for different-sized users.

13. The posture control chair of claim 12, wherein the foot plate is connected under the seat and attached to a pillar vertical section of the seat frame via detachable clamp.

14. The posture control chair of claim 13, wherein the footrest allows dynamic adjustment to accommodate the user's position when using the knee rest.

15. The posture control chair of claim 14, wherein the footrest is detachable from the chair and remains connected with the knee rest during undesired use of the knee pad unit.

16. The posture control chair of claim 11, wherein the footrest has rough dimensions consisting of a plate with a maximum width of 16 inches and a maximum length of 12 inches (heel to toe).

* * * * *